US012558635B2

(12) United States Patent
Wellner

(10) Patent No.: US 12,558,635 B2
(45) Date of Patent: Feb. 24, 2026

(54) TOY

(71) Applicant: DAY1 GMBH, Cologne (DE)

(72) Inventor: Thomas Wellner, Cologne (DE)

(73) Assignee: MagToys GmbH, Garching (DE)

( * ) Notice: Subject to any disclaimer, the term of this patent is extended or adjusted under 35 U.S.C. 154(b) by 136 days.

(21) Appl. No.: 18/267,896

(22) PCT Filed: Dec. 17, 2021

(86) PCT No.: PCT/EP2021/086497
§ 371 (c)(1),
(2) Date: Jun. 16, 2023

(87) PCT Pub. No.: WO2022/129529
PCT Pub. Date: Jun. 23, 2022

(65) Prior Publication Data

US 2024/0050870 A1 Feb. 15, 2024

(30) Foreign Application Priority Data

Dec. 18, 2020 (DE) ..... 10 2020 216 268.9

(51) Int. Cl.
*A63H 33/26* (2006.01)

(52) U.S. Cl.
CPC ..... *A63H 33/26* (2013.01)

(58) Field of Classification Search
CPC .... A63H 33/00; A63H 33/26; A63B 2208/12; A63F 7/382; A63F 9/34; A63F 2250/485
(Continued)

(56) References Cited

U.S. PATENT DOCUMENTS 870,146 A * 11/1907 Webb ..... A63H 33/00
124/20.1
1,005,853 A * 10/1911 Lewis ..... A63H 33/26
446/132

(Continued)

FOREIGN PATENT DOCUMENTS

DE 8713826 U1 1/1988
DE 20317232 U1 4/2004
GB 598488 A * 2/1948 ..... A63F 7/382

OTHER PUBLICATIONS

International Search Report and Written Opinion dated Jun. 3, 2022, for International Application PCT/EP2021/086497.

*Primary Examiner* — Alexander R Niconovich
(74) *Attorney, Agent, or Firm* — The Dobrusin Law Firm, P.C.

(57) ABSTRACT

A toy having a main body; a first magnet; and a mating piece; the first magnet and the mating piece are attached to the main body and are moveable independently of one another and cab can be brought into a jointly suspended state, in which the mating piece is magnetically attracted by the first magnet, without the first magnet and the mating piece touching; the main body has a rod-shaped handle portion, the main body has a holding portion connected to the handle portion that includes a first attachment region and a second attachment region; in the first attachment region, the first magnet and, in the second attachment region, the mating piece being attached so as to be able to move; the first attachment region and the second attachment region are mirror-symmetrical in relation to an imaginary longitudinal axis of the handle portion.

19 Claims, 4 Drawing Sheets

(58) Field of Classification Search
USPC ..... 446/129, 133; 273/456
See application file for complete search history.

(56) References Cited

U.S. PATENT DOCUMENTS 2,702,191 A * 2/1955 Lemelson ..... F41J 7/04 273/393
2,726,483 A * 12/1955 Hughes ..... A63H 13/20 362/102
2,818,680 A * 1/1958 Borsos ..... A63H 33/26 472/57
3,037,322 A * 6/1962 Baumgartner, Jr. ... A63H 33/00 362/35
3,325,940 A * 6/1967 Davis ..... A63F 7/382 D21/466
3,550,316 A * 12/1970 MacPherson ..... A63H 33/26 446/133
3,609,606 A * 9/1971 Podesto ..... A63H 33/26 D11/141
3,864,872 A * 2/1975 Hoetzel ..... A63F 9/34 273/448
3,940,878 A * 3/1976 Panico ..... A63B 67/10 446/247
3,955,315 A * 5/1976 Goodman ..... A63H 33/26 472/137
4,011,674 A * 3/1977 Jacobson ..... A63H 33/26 446/131
4,031,660 A * 6/1977 Chen ..... A63H 33/26 446/485
4,250,659 A * 2/1981 Ishiguro ..... A63H 13/12 446/133
4,531,923 A * 7/1985 Lohr ..... A63H 33/26 273/109
4,568,301 A * 2/1986 Hawley, Jr. ..... A63H 33/26 446/134
4,690,657 A * 9/1987 Lodrick, Sr. ..... A63F 9/34 273/456
4,753,623 A * 6/1988 Krut ..... A63H 33/26 446/256
4,901,456 A * 2/1990 Cotutsca ..... G09F 19/02 40/538
5,026,314 A * 6/1991 Samson ..... A63H 33/26 446/133
5,052,968 A * 10/1991 Lodrick, Sr. ..... A63F 9/34 446/134
5,190,491 A * 3/1993 Connelly ..... A63H 33/26 446/236
5,589,721 A * 12/1996 Han ..... G09F 9/375 310/90.5
5,842,902 A * 12/1998 Liff ..... A63H 33/26 446/485
6,413,144 B1 * 7/2002 Williams ..... A63H 1/04 446/236
7,275,974 B2 * 10/2007 Perry ..... A63H 33/26 273/109
7,361,074 B1 * 4/2008 Periman ..... A63H 37/00 362/199
7,470,222 B1 * 12/2008 Mkrtchyan ..... A63B 21/22 446/236
7,905,758 B2 * 3/2011 Millstein ..... A63H 33/26 446/131
8,717,129 B1 * 5/2014 Cash ..... G09F 19/12 446/129
9,478,336 B2 * 10/2016 Henning, III ..... H01F 7/0242
11,089,850 B1 * 8/2021 Liu ..... A44C 25/001
12,257,527 B2 * 3/2025 Kariuki ..... A63H 33/046
2002/0177384 A1 * 11/2002 Mankowski ..... A63H 17/002 446/471
2003/0124950 A1 * 7/2003 Turner ..... A63H 1/30 446/236
2004/0218383 A1 * 11/2004 Bailey, III ..... A63B 5/20 362/269
2008/0057821 A1 * 3/2008 Perry ..... A63H 1/02 446/46

* cited by examiner

TOY

PRIOR ART

The present invention relates to a toy having a main body, a first magnet and a mating piece.

Toys of this type can be used by children or adults to play games of skill. For example, a fishing game with a toy having a main body in the form of a rod is known in the prior art. A permanent magnet is movably attached to the main body by means of a thread. The permanent magnet can be aligned by a player by skillfully moving the main body in such a way that the latter is aligned with a mating piece—for example a separate metallic part or a mating piece having a metallic region. In the case of known fishing games, these mating pieces are often designed in the form of a fish. The mating piece is then magnetically attracted by the permanent magnet until it touches it and the mating piece sticks to the permanent magnet. A fishing game of this type typically requires a structure with a vessel or a delimited region from which mating pieces can be fished out. Therefore, such toys can usually only be used when set up on a table and can be utilized in mobile fashion, for example on a journey, only to a limited extent.

DE 87 13 826 U, DE 203 17 232 U1 and U.S. Pat. No. 3,955,315 A also disclose decorative articles in the case of which two magnets are attached to a main body so as to be able to move independently of one another in such a way that the magnets can be brought into a suspended state, without the magnets touching. These decorative articles can also only be used when set up on a table and can be utilized in mobile fashion, for example on a journey, only with restrictions.

DISCLOSURE OF THE INVENTION

The object of the present invention is to specify a toy for a game of skill which can be used in mobile fashion, for example on journeys.

According to the invention, a toy having the features of patent claim 1 is proposed.

By moving the main body, the first magnet and the mating piece, both of which are attached to the main body so as to be able to move independently of one another, are each set in movement. The main body can, for example, be moved from a state in which the mating piece is not magnetically attracted by the first magnet, for example because a distance of the first magnet from the mating piece is too great, in order to exert an appreciable magnetic force of attraction on the mating piece. By skillfully moving the main body, the user can influence the movements of the first magnet and the mating piece, in order to bring them into the suspended state. In this suspended state, the mating piece is magnetically attracted by the first magnet, but the first magnet and the mating piece do not touch. Since both the first magnet and the mating piece are attached to the main body, the toy according to the invention can be utilized without elements that are separate from the main body. In particular, no separate metallic parts are required. This facilitates the mobile use of the toy, for example on journeys. According to the invention, the first magnet and the mating piece are movably attached to the main body in such a way that the first magnet and the mating piece do not touch in the suspended state. This makes it possible to reduce the probability of the first magnet and the mating piece attracting and aligning with one another without action on the part of a user. Since the first magnet and mating piece do not touch in the suspended state, the transfer of the toy from the suspended state to another state is moreover facilitated. For example, it is possible for the user to be able to terminate the suspended state by way of a further, skillful movement of the main body, the magnetic attraction being overcome. The toy enables a novel play experience which requires an increased level of skill.

According to an advantageous configuration of the invention, the first magnet is a permanent magnet. According to the invention, the permanent magnet under consideration is a magnet made of a piece of hard magnetic material. An alternative designation for a permanent magnet is static magnet. The material of the permanent magnet may comprise iron, cobalt, nickel, a ferrite, or neodymium. For example, the material may be a neodymium-iron-boron alloy.

According to an alternative, advantageous configuration, it is provided that the first magnet is an electromagnet. Such a configuration offers the advantage that the suspended state can be overcome by deactivating the electromagnet. Preferably, the electromagnet is selectively switchable between a non-magnetic state and a magnetic state. The toy, in particular the main body of the toy, may have an actuating element, for example a switch or push button, by means of which the electromagnet can be switched between the non-magnetic state and a magnetic state. Preferably, in or on the main body there is an energy store for supplying electrical energy to the electromagnet, for example a battery, an accumulator or a capacitor.

According to a preferred configuration of the invention, the mating piece is a second magnet. The second magnet may be a permanent magnet or an electromagnet. A particularly preferred configuration, however, comprises a first magnet in the form of a first permanent magnet and a mating piece in the form of a second permanent magnet. A toy according to such a particularly preferred configuration therefore comprises a main body, a first permanent magnet and a second permanent magnet, the first permanent magnet and the second permanent magnet being attached to the main body so as to be able to move independently of one another in such a way that the first and the second permanent magnet can be brought into a jointly suspended state in which the first and the second permanent magnet are magnetically attracted to one another without touching. The use of two permanent magnets makes it possible to increase the magnetic force of attraction to one another.

According to an advantageous configuration, it is provided that the first magnet is attached to the main body by means of a first flexible connecting element. As an alternative or in addition, the mating piece, in particular the second magnet, may be attached to the main body by means of a second flexible connecting element. The respective flexible connecting element may enable a movable attachment to the main body, for example in that the connecting element can deform. Preferably, the respective flexible connecting element is subject to tensile loading in the jointly suspended state. Preferably, the respective flexible connecting element is an elastic connecting element which is strong under tension.

In this connection, it is preferred if the first and/or the second flexible connecting element is in the form of an elongate and pliable, flexible connecting element which is strong under tension. Particularly preferably, the first and/or the second flexible connecting element is in the form of a thread or a cord or a strap or a band or a chain. The first and/or the second flexible connecting element may comprise, for example, ultra-high-molecular-weight polyethylene (UHMWPE, also known under the designation Dyneema®), or polyamide, in particular polyhexamethyleneadipamide (also known under the designation Nylon) or cotton, preferably may consist of one of the aforementioned materials. The first and/or the second flexible connecting element preferably has a diameter in the range of 0.05 mm to 0.5 mm, preferably in the range of 0.08 mm to 0.35 mm.

According to an alternative, advantageous configuration, it is provided that the first and/or the second flexible connecting element is in the form of a spring element which is subject to tensile load in the jointly suspended state. Preferably, the spring element is disposed on the main body so as to be able to move, for example pivot. The spring element may for example be a helical tension spring.

An advantageous configuration of the invention provides that the main body has a first attachment region, in which the first magnet is attached so as to be able to move, in particular by means of the first flexible connecting element, and a second attachment region, in which the mating piece, preferably the second magnet, is attached so as to be able to move, in particular by means of the second flexible connecting element.

Preferably, the first attachment region and/or the second attachment region has an adhesive bond or an eye or a hook or a recess.

A preferred configuration of the invention provides that the first magnet is attached to the main body so as to be able to move by means of a first bearing, in particular a rolling bearing or plain bearing, and/or that the mating piece, preferably the second magnet, is attached to the main body so as to be able to move by means of a second bearing, in particular a rolling bearing or plain bearing. The first and the second bearing may for example be in the form of a rolling bearing or a plain bearing. If the bearing is in the form of a rolling bearing, it is preferably a ball bearing. The respective bearing makes it possible to enable a rotational movement of the first magnet or of the mating piece, in particular the second magnet. In the case of a configuration in which a flexible connecting means is used for attachment purposes, the bearing makes it possible to prevent the flexible connecting means inadvertently coiling up on the main body.

In the case of a configuration in which the main body has a first attachment region, in which the first magnet is attached so as to be able to move, in particular by means of the first flexible connecting element, and a second attachment region, in which the mating piece, preferably the second magnet, is attached so as to be able to move, in particular by means of the second flexible connecting element, it is preferably provided that the first attachment region and/or the second attachment region comprises a bearing, in particular a rolling bearing or a plain bearing. The bearing may have a first bearing ring, which is fastened to the main body in the respective attachment region. A second bearing ring, which is rotatable relative to the first bearing ring, may be connected to the respective magnet or mating piece, in particular by means of the respective flexible connecting element.

According to an advantageous configuration of the invention, it is provided that the bearing, in particular rolling bearing or plain bearing, has an axis of rotation which is perpendicular to an imaginary connecting line between the first attachment region and the second attachment region. In the case of such an arrangement of the one or more rolling bearings or plain bearings, the first magnet and the mating piece, in particular the second magnet, can be brought toward the suspended state by means of a rotational movement of the respective bearing.

An advantageous configuration of the invention provides that the first magnet and the mating piece, in particular the second magnet, are disposed on the main body so as to be able to move in such a way that a ratio of a magnet distance between the first magnet and the mating piece in the suspended state to an attachment distance between the first attachment region and the second attachment region is less than 0.3. Preferably, the ratio is less than 0.2, particularly preferably less than 0.1. For example, the ratio may be 0.09. The selection of the ratio makes it possible to set the degree of difficulty for achieving the suspended state.

According to the invention, the main body has a rod-like handle portion, which is designed in such a way that the handle portion can be grasped by a hand, in order to set the first magnet and the mating piece, in particular the second magnet, in movement. The handle portion may allow the user to comfortably grasp the toy, preferably with just one hand.

An advantageous configuration provides that the handle portion has a projection. The projection allows a user of the toy to grasp the main body with the fingers exclusively at the projection, in order to move the main body. The projection may extend around the entire circumference of the handle portion. The projection preferably has a curved form, in particular spherically curved form. The spherically curved projection offers the advantage that the user can roll the main body back and forth in their fingers, in order to align the main body.

According to the invention, it is provided that the main body has a holding portion, which is connected to the handle portion and has a first and a second attachment region, with, in the first attachment region, the first magnet being attached so as to be able to move, in particular by means of the first flexible connecting element, and, in the second attachment region, the mating piece, preferably the second magnet, being attached so as to be able to move, in particular by means of the second flexible connecting element, the holding portion being in the form of a fork, in particular with exactly two fork tines, or in the form of a frame. The holding portion in the form of a fork or frame makes it possible to provide a robust structure which does not excessively limit the freedom of movement of the first magnet and the mating piece, in particular the second magnet. The holding portion in the form of a fork can, for example, have a U shape or a V shape or a C shape. The holding portion in the form of a frame can, for example, have the basic shape of a rectangle or a circle or an oval. According to the invention, it is provided that the first and the second attachment region are mirror-symmetrical in relation to an imaginary longitudinal axis of the handle portion.

With regard to a configuration with a holding portion in the form of a fork having exactly two fork tines, it has proven to be advantageous when the first attachment region and the second attachment region are disposed at a respective free end of one of the two fork tines.

Further details, features and advantages of the invention will emerge from the drawings and from the following description of preferred exemplary embodiments on the basis of the drawings. In this respect, the drawings illustrate merely exemplary embodiments of the invention, which do not have a limiting effect on the idea of the invention.

BRIEF DESCRIPTION OF THE FIGURES

FIG. 1(*b*) shows a perspective illustration of a second exemplary embodiment of a toy according to the invention.

FIG. 1(*c*) shows a perspective illustration of a third exemplary embodiment of a toy according to the invention.

FIG. 3(*b*) shows a plan view of the toy according to FIG. 2.

FIG. 3(*c*) shows a further side view of the toy according to FIG. 2.

EMBODIMENTS OF THE INVENTION

In the various figures, the same parts are always provided with the same reference signs and are therefore generally also only mentioned or explained once in each case.

Figure 1:
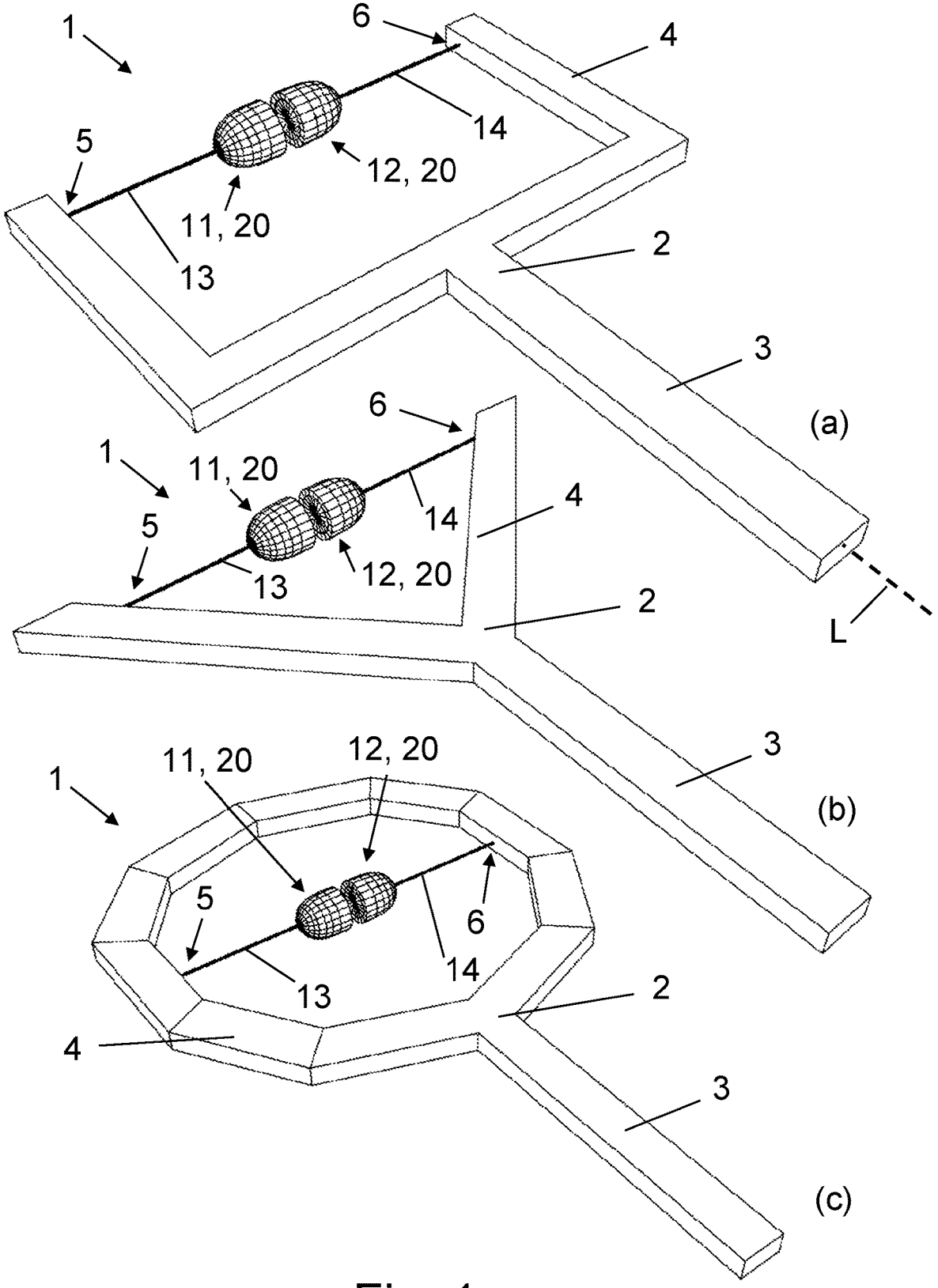
FIG. 1(*a*) shows a perspective illustration of a first exemplary embodiment of a toy according to the invention.

The illustration in FIG. 1(*a*) shows a first exemplary embodiment of a toy 1 according to the invention. The toy comprises a main body 2, to which a first magnet in the form of a permanent magnet 11 and a mating piece 12 are attached so as to be able to move independently of one another. The mating piece 12 is in the form of a second magnet. The second magnet is a permanent magnet 12. The attachment of the first permanent magnet 11 and the second permanent magnet 12 to the main body is configured here such that the first permanent magnet 11 and the second permanent magnet 12 can be brought into a jointly suspended state, in which the first and the second permanent magnet 11, 12 are magnetically attracted to one another without touching. This suspended state is illustrated in the image according to FIG. 1(*a*).

The permanent magnets 11, 12 are each received in a magnet holder 20, which enables the connection of the respective permanent magnet 11, 12 to a flexible connecting element 13, 14. The first permanent magnet 11 is attached to a first attachment region 5 of the main body 2 so as to be able to move by means of a first flexible connecting element 13. The second permanent magnet 12 is attached to a second attachment region 6 of the main body 2 so as to be able to move by means of a second flexible connecting element 14. The flexible connecting elements 13, 14 are preferably in the form of threads. In the case of the exemplary embodiment according to FIG. 1(*a*), the first attachment region 5 and/or the second attachment region 6 each have an adhesive bond or an eye or a hook or a recess via which the respective flexible connecting element 13, 14 is attached.

The length of the flexible connecting element used to attach the permanent magnets 11, 12 is selected such that the permanent magnets 11, 12, which are attracted to one another, are prevented from touching in the suspended state. In this respect, in the suspended state, there is a magnet distance between the first permanent magnet 11 and the second permanent magnet 12 which can be several millimeters, for example 3 mm or 4 mm or 5 mm or 10 mm. In this case, the ratio of the magnet distance between the first permanent magnet 11 and the second permanent magnet 12 in the suspended state to an attachment distance between the first attachment region 5 and the second attachment region 6 is less than 0.3. Preferably, the ratio is less than 0.2, particularly preferably less than 0.1, for example 0.09.

The toy 1 can be used, within the context of a game of skill, to bring the two permanent magnets 11, 12 out of any state in which the two permanent magnets 11, 12 are not attracted to one another into the suspended state shown in FIG. 1(*a*) by skillfully moving the toy 1. For example, the permanent magnets 11, 12 can firstly assume a state in which the permanent magnets 11, 12 are not aligned with one another, i.e. are not magnetically attracted to one another. Proceeding from such a state, the user can set the permanent magnets 11, 12 in movement by possibly skillfully moving the main body 2 and attempt to transfer the permanent magnets 11, 12 into the suspended state.

In the case of the toy 1 according to the first exemplary embodiment, the main body 2 comprises a rod-like handle portion 3. The main body 2 can be grasped with a hand at the grip portion 3, in order to set the permanent magnets 11, 12 in movement. The grip portion 3 is connected to a holding portion 4, in which the first and the second attachment region 5, 6 are disposed. According to FIG. 1(*a*), the holding portion 4 is designed in the manner of a U-shaped fork. The holding portion 4 has two fork tines, at the respective free ends of which the attachment regions 5, 6, by means of which the permanent magnets 11, 12 are attached to the main body 2, are provided. The attachment regions 5, 6 are mirror-symmetrical in relation to an imaginary longitudinal axis L of the rod-like handle portion 3.

According to a modification of the exemplary embodiment shown in FIG. 1(*a*), the flexible connecting elements are in the form of a cord or a strap or a band or a chain. It can also alternatively be provided that the permanent magnets 11, 12 are each attached to the main body 2 by means of a spring element, for example a helical tension spring.

The illustration in FIG. 1(*b*) shows a toy 1 according to a second exemplary embodiment of the invention, which in principle is similar to the toy shown in FIG. 1(*a*), and therefore reference is made to the statements relating to FIG. 1(*a*). By contrast to the exemplary embodiment according to FIG. 1(*a*), the holding portion 4 is designed in the manner of a V-shaped fork. The fork tines of this holding portion 4 run along intersecting straight lines. At the intersection point of the fork times, the handle portion 3 is connected to the holding portion 4.

The illustration in FIG. 1(*c*) shows a third exemplary embodiment of a toy according to the invention. This toy 1 is also similar in principle to the toy shown in FIG. 1(*a*), and therefore reference is made to the statements relating to FIG. 1(*a*). However, by contrast to the fork-like holding portion 4 shown in FIG. 1(*a*) and FIG. 1(*b*), the holding portion is designed as a holding portion in the form of a frame. The attachment regions 5, 6 are disposed at diametrically opposite positions on the frame. The frame has a substantially oval basic shape.

Figure 2:
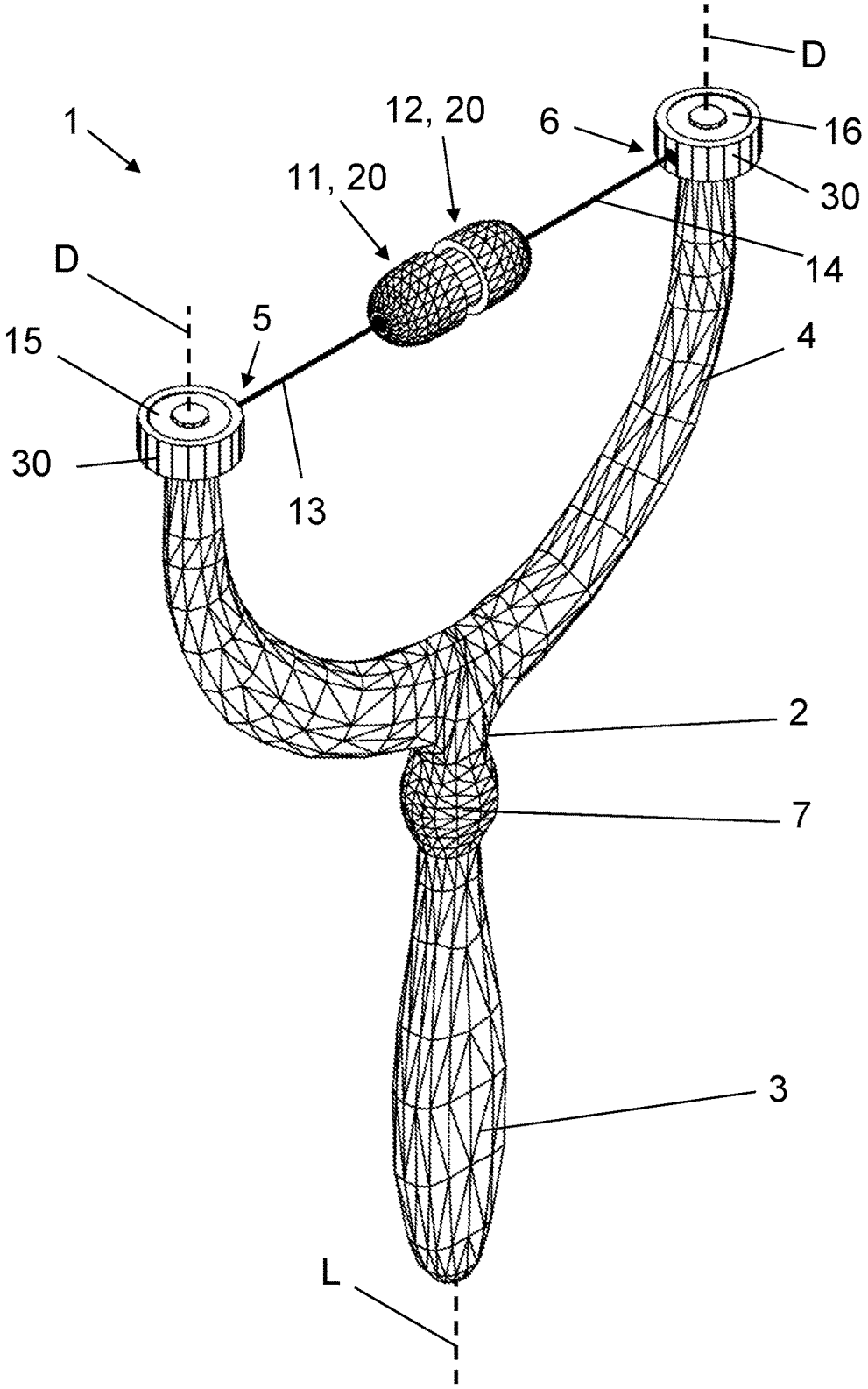
FIG. 2 shows a perspective illustration of a fourth exemplary embodiment of a toy according to the invention.
Figure 3:
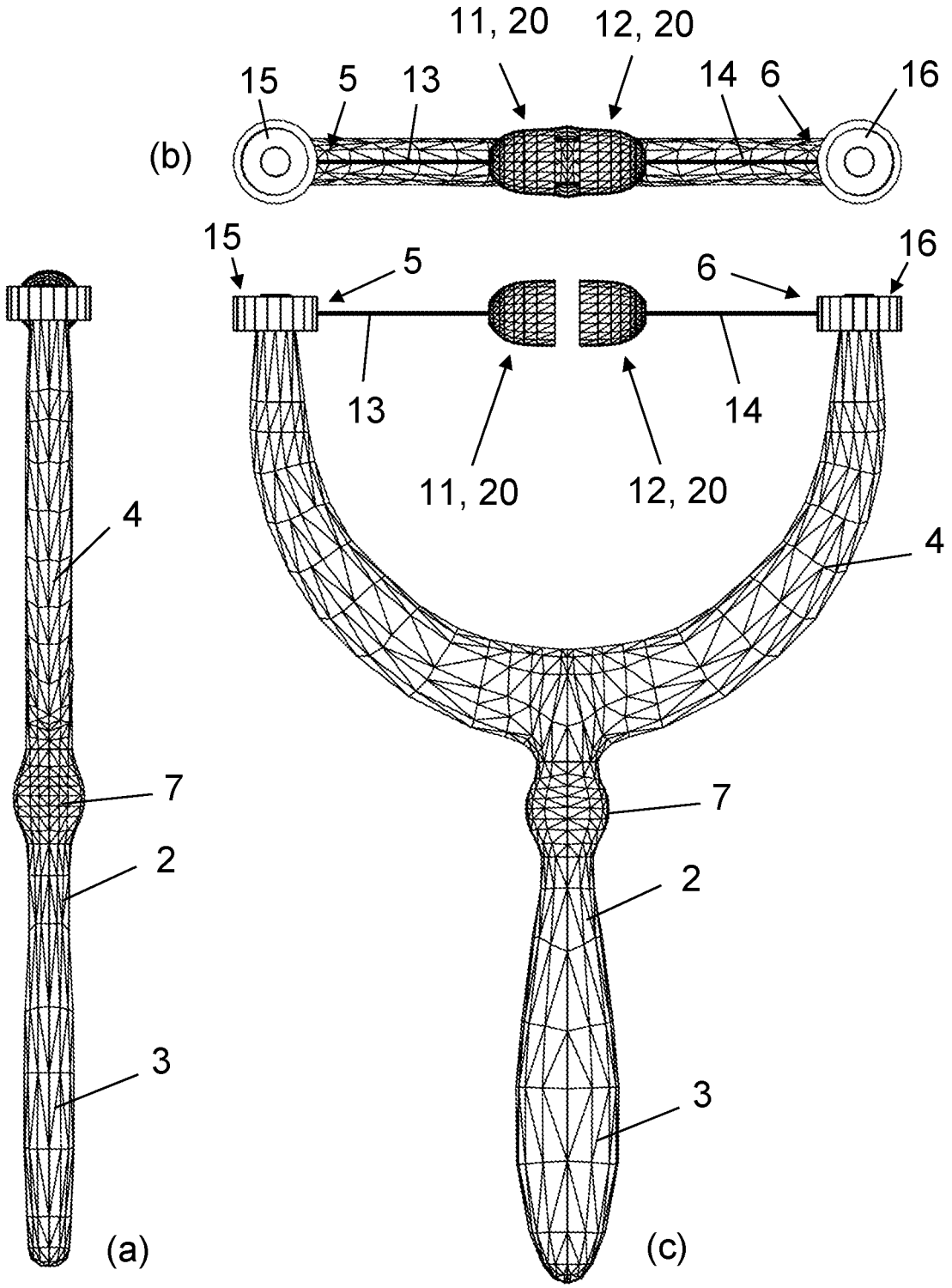
FIG. 3(*a*) shows a side view of the toy according to FIG. 2.

The illustrations in FIGS. 2 and 3(*a*), (*b*) and (*c*) show a toy 1 according to a fourth exemplary embodiment of the invention, which in principle is similar to the toy shown in FIG. 1(*a*), and therefore reference is made in turn to the statements relating to FIG. 1(*a*). In order to avoid the flexible connecting elements 13, 14 inadvertently coiling up when the permanent magnets 11, 12 are being moved in relation to the main body 2, in the case of the toy 1 according to the fourth exemplary embodiment particular precautions are taken.

The first permanent magnet 11 is attached to the main body 2 so as to be able to move by means of a first bearing 15, in particular a rolling bearing or plain bearing. Furthermore, the mating piece 12, here the second permanent magnet 12, is attached to the main body 2 so as to be able to move by means of a second bearing 16, in particular a rolling bearing or plain bearing.

Here, the first bearing 15 is provided in the first attachment region 5 on the main body. In the present case, the bearing 15 is disposed at the free end of a first fork tine of the fork-shaped holding element 4. The second bearing 16 is provided in the second attachment region 6 on the main body 2. This second attachment region is located at the free end of a second fork tine of the holding element 4.

The two bearings 15, 16 each have an axis of rotation D which is perpendicular to an imaginary connecting line between the first attachment region 5 and the second attachment region 6. These axes of rotation D are parallel to the longitudinal axis L of the rod-like handle portion 3.

The rod-like handle portion 3 of the main body 2 comprises a spherically curved projection 7. This projection is designed such that a user can rotate the toy 1 by rolling the curvature back and forth in their fingers in all spatial directions.

Figure 4:
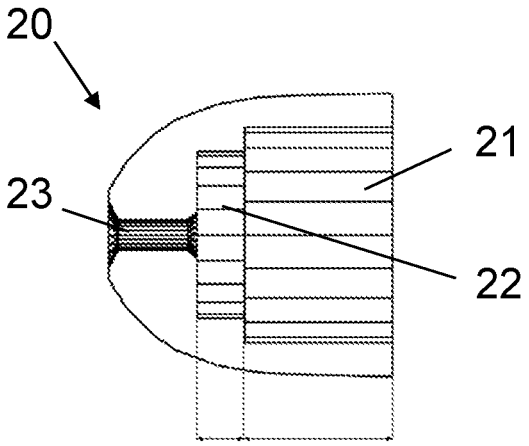
FIG. 4 shows a sectional illustration through a magnet holder for a toy according to the invention.

On the basis of the illustration in FIG. 4, a magnet holder 20 is to be described below which can be used as holder of the first permanent magnet 11 and the mating piece, or the second permanent magnet 12, in the case of the exemplary embodiments of the toy 1 that were described above. The magnet holder 20 comprises a magnet receptacle 21, which is in the form of a blind hole in a first side of the magnet holder 20. The respective permanent magnet 11, 12, or a metallic mating piece, can be received in the magnet receptacle 21. On a second side, situated opposite the first side, of the magnet holder 20, the latter has a fastening opening 23, through which a flexible connecting element 13, 14 can be guided. An empty space 22 is provided in the region between the magnet receptacle 21 and the fastening opening 23. The empty space 22, like the magnet receptacle 21, is likewise in the form of a blind hole but has a smaller diameter than the magnet receptacle 21. The flexible connecting element guided through the fastening opening 23 can be fixed and/or knotted in the empty space.

Figure 5:
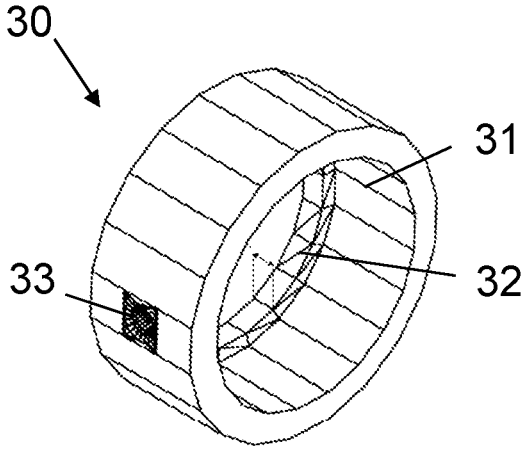
FIG. 5 shows a perspective illustration of a bearing holder for a toy according to the invention.

FIG. 5 shows a bearing holder 30, by means of which the bearings 15, 16 can be fastened to the main body 2 of the toy according to the fourth exemplary embodiment. The bearing holder 30 comprises a cylindrical bearing receptacle 31, in which a bearing, for example a plain bearing or a rolling bearing, can be received. The respective bearing 15, 16 may be disposed in the bearing receptacle 31 in such a way that an outer ring of the bearing is in contact with the inner contour of the bearing receptacle 31 and an inner ring of the bearing is in contact with the free end of the fork tine of the main body 2. The bearing holder 30 also comprises a fastening opening 33, through which the respective flexible connecting element 13, 14 is guided. The bearing receptacle 31 is delimited in the axial direction by a rim 32.

LIST OF REFERENCE SIGNS

1 Toy
2 Main body
3 Handle portion
4 Holding portion
5 First attachment region
6 Second attachment region
7 Projection
11 First permanent magnet
12 Second permanent magnet, mating piece
13 First flexible connecting element
14 Second flexible connecting element
15 First bearing
16 Second bearing
20 Magnet holder
21 Magnet receptacle
22 Empty space
23 Fastening opening
30 Bearing holder
31 Bearing receptacle
32 Rim
33 Fastening opening
D Axis of rotation
L Longitudinal axis

The invention claimed is:

1. A toy having:
a. a main body;
b. a first magnet; and
c. a mating piece;
wherein the first magnet and the mating piece are attached to the main body so as to be able to move independently of one another in such a way that the first magnet and the mating piece can be brought into a jointly suspended state, in which the mating piece is magnetically attracted by the first magnet, without the first magnet and the mating piece touching;
wherein the main body comprises an elongate rod-shaped handle portion extending along an imaginary longitudinal axis extending between the first magnet and the mating piece to allow the handle portion to be grasped by a hand to set the first magnet and the mating piece in movement;
wherein the main body comprises a holding portion, which is connected to the handle portion, the holding portion comprises a first attachment region and a second attachment region; in the first attachment region, the first magnet and, in the second attachment region, the mating piece being attached so as to be able to move; the holding portion comprising a fork or a frame shape;
wherein the first attachment region and the second attachment region are mirror-symmetrical in relation to the imaginary longitudinal axis of the handle portion; and
wherein the handle portion comprises a spherically-curved projection that is arranged proximal to the holding portion, the spherically-curved projection is configured for a user to rotate the toy by rolling a curvature of the spherically-curved projection back and forth in their hand.

2. The toy as claimed in claim 1, wherein the first magnet is a permanent magnet.

3. The toy as claimed in claim 1, wherein the first magnet is an electromagnet.

4. The toy as claimed in claim 1, wherein the mating piece is a second magnet or a permanent magnet.

5. The toy as claimed in claim 4, wherein the first magnet is attached to the main body by a first flexible connecting element and/or wherein the mating piece is attached to the main body by a second flexible connecting element.

6. The toy as claimed in claim 5, wherein the first flexible connecting element and/or the second flexible connecting element is in a form of an elongate and pliable, flexible connecting element which is strong under tension and in a form of a thread or a cord or a strap or a band or a chain.

7. The toy as claimed in claim 5, wherein the main body has a first attachment region, in which the first magnet is attached so as to be able to move by the first flexible connecting element, and a second attachment region, in which the mating piece is attached so as to be able to move by the second flexible connecting element.

8. The toy as claimed in claim 7, wherein the first attachment region and/or the second attachment region has an adhesive bond or an eye or a hook or a recess.

9. The toy as claimed in claim 7, wherein the first magnet is attached to the main body so as to be able to move by a first bearing or a first rolling bearing or a first plain bearing, and/or wherein the mating piece is attached to the main body so as to be able to move by a second bearing or a second rolling bearing or a second plain bearing.

10. The toy as claimed in claim 9, wherein the first bearing or the second bearing has an axis of rotation which is perpendicular to an imaginary connecting line between the first attachment region and the second attachment region.

11. The toy as claimed in claim 7, wherein the first attachment region and/or the second attachment region has a bearing or a rolling bearing or a slide bearing.

12. The toy as claimed in claim 7, wherein the first magnet and the mating piece are disposed on the main body so as to be able to move in such a way that a ratio of a magnet distance between the first magnet and the mating piece in the suspended state to an attachment distance between the first attachment region and the second attachment region is less than 0.3, or less than 0.2, or less than 0.1, or 0.09.

13. The toy as claimed in claim 1, wherein the holding portion comprises exactly two fork tines.

14. The toy as claimed in claim 13, wherein the first attachment region and the second attachment region are disposed at a respective free end of one of the two fork tines.

15. A toy comprising:

a body comprising an elongate handle configured to be grasped by a hand to set the first magnet and a mating piece in movement, a holding portion extending from a distal end of the handle, the holding portion comprising a first attachment region and a second attachment region, wherein the handle extends along a longitudinal axis and the first attachment region and the second attachment region are mirror-symmetrical relative to the longitudinal axis of the handle;

the first magnet is attached to the first attachment region with a first flexible connecting element;

the mating piece is attached to the second attachment region with a second flexible connecting element, wherein the second flexible connecting element is a separate and discrete flexible connecting element from the first flexible connecting element;

wherein the first magnet and the mating piece are configured to move independently of one another and are further configured to be brought into a jointly suspended state by the mating piece being magnetically attracted to the first magnet;

wherein in the jointly suspended state, the first magnet and the mating piece oppose each other on opposite sides of the longitudinal axis wherein the handle comprises a spherically-curved projection that is arranged proximal to the holding portion, the spherically-curved projection is configured for a user to rotate the toy by rolling a curvature of the spherically-curved projection back and forth in their hand.

16. The toy according to claim 15, wherein the body and the holding portion of the toy have a Y-shaped profile, wherein a gap is defined between the first magnet and the mating piece in the jointly suspended state, the longitudinal axis extends through the gap.

17. The toy according to claim 16, wherein the toy comprises a first bearing supported at a distal end of the first attachment region and a second bearing supported at a distal end of the second attachment region, wherein the first magnet is attached to the first attachment region via the first bearing with the first flexible connecting element, and the mating pieces is attached to the second attachment region via the second bearing with the second flexible connecting element.

18. The toy according to claim 17, wherein the first bearing is configured to rotate about a first axis that is parallel to the longitudinal axis of the handle, and the second bearing is configured to rotate about a second axis that is parallel to the longitudinal axis of the handle, and, wherein a space between the first axis and the longitudinal axis is substantially equivalent to a space between the second axis and the longitudinal axis.

19. The toy according to claim 18, wherein the toy comprises a first magnet holder comprising a first receptacle configured to receive the first magnet, the first magnet holder comprises: i) a first side having a first blind hole, ii) a second side that is opposite the first side that includes a fastening opening through which the first flexible connecting element is received, and iii) an empty space between the first receptacle and the fastening opening, wherein the empty space comprises a blind hole that has a diameter that is smaller than a diameter of the first receptacle, wherein the first flexible connecting element is guided through the fastening opening and is fixed or knotted in the empty space.

* * * * *